United States Patent [19]

Brown

[11] 4,094,769

[45] June 13, 1978

[54] METHOD AND APPARATUS FOR RETORTING OIL SHALE

[75] Inventor: Harold Brown, Denver, Colo.

[73] Assignee: Mineral Concentrates & Chemical Company, Inc., Winnemucca, Nev.

[21] Appl. No.: 805,983

[22] Filed: Jun. 13, 1977

[51] Int. Cl.[2] ..... C10G 1/02

[52] U.S. Cl. ..... 208/11 R; 201/7; 201/33; 202/118; 202/128

[58] Field of Search ..... 208/11 R; 201/7, 30, 201/33; 202/118, 128

[56] References Cited

U.S. PATENT DOCUMENTS

| | | | |
|---|---|---|---|
| 1,196,470 | 8/1916 | Aldama | 208/11 R |
| 1,272,377 | 7/1918 | Catlin | 202/118 |
| 1,297,022 | 3/1919 | Shreves | 202/118 |
| 1,468,379 | 9/1923 | Easton | 202/118 |
| 1,490,213 | 4/1924 | Jenson | 202/118 |
| 1,810,828 | 6/1931 | Hayes | 201/33 |
| 2,983,653 | 5/1961 | Danulat et al. | 208/11 R |
| 3,350,280 | 10/1967 | West | 208/11 R |

*Primary Examiner*—Herbert Levine

*Attorney, Agent, or Firm*—Ancel W. Lewis, Jr.

[57] ABSTRACT

In a method and apparatus for recovering oil products from oil shale and like materials, controlled amounts of raw oil shale are delivered into an upper inlet of a downwardly sloping retort chamber that is constructed as readily portable. The raw oil shale is first moved in a direction countercurrent to gravity flow and crushed in the retort chamber by means of a rotating member that also serves to retain the oil shale in the retort chamber until a satisfactory recovery is completed. The crushed oil shale is confined to a relatively thin, downwardly moving layer in contact with a heated, inner, annular wall surface and moves by gravity flow between the inlet and a lower outlet to produce oil product vapors that rise to an upper portion of the retort chamber. The moving layer of the oil shale becomes spent as it passes through the retort chamber and finally is selectively discharged through the lower outlet. The oil product vapors are removed from the retort chamber into a condensing tube in which the vapors are condensed to a liquid form. The oil products are removed from the condenser by weight or are further refined in an adjacent refinery.

27 Claims, 11 Drawing Figures

METHOD AND APPARATUS FOR RETORTING OIL SHALE

FIELD OF THE INVENTION

This invention relates to a novel and improved method and apparatus for the recovery of oil products from oil shale and like materials.

BACKGROUND OF THE INVENTION

In view of the rapid rise in the consumption of oil products and the untapped reserves of oil shale, there has been increased interest in finding and developing novel and improved methods and apparatus for recovering oil products from raw oil shale.

Methods and apparatus heretofore provided for recovering oil products from raw oil shale have been classified according to heat application as (1) heat transferred through a wall, (2) heat transferred from the combustion in the retort, (3) heat transferred by passing previously heated gases, and (4) heat transferred by introducing hot solids.

A general object of the present invention is to provide a novel and improved method and apparatus for the recovery of oil products from oil bearing materials, particularly oil shale, which has been found to be satisfactory from the standpoint of operability, economics and completeness of recovery.

Another object of the present invention is to provide a novel method and apparatus for the recovery of oil from oil shale characterized by highly effective heat transfer to the raw oil shale and a crushing of the oil shale to a reduced size as well as a satisfactory holding time to allow for a substantially complete recovery while passing rhrough a heated retort chamber.

A further object of the present invention is to provide a novel method of heating a relatively thin layer or body of crushed shale as it is continuously moved by gravity flow over a heated wall surface of an annular flow passage between an inlet and an outlet with the capability of adjusting the heating time as required.

Yet a further object of the present invention is to provide a novel method and apparatus for retorting oil shale characterized by the steps of preheating the raw oil shale, then crushing and moving the shale against gravity flow in a retort chamber by a moving blade, thereby retaining the oil shale in the retort chamber for an adequate holding time for completeness of recovery, and confining the shale to a layer or bed in a narrow, annular, heated passage during continuous flow from an inlet to an outlet.

Still another object of the present invention is to provide a novel method and apparatus for the recovery of oil shale that may be specially adapted for successive retorting and refining on a relatively small scale as a readily portable unit or adapted for larger scale operations.

SUMMARY OF THE INVENTION

In accordance with the present invention, controlled amounts of raw oil shale are delivered into an upper inlet of an elongated heat-conductive housing having inner heat-conductive wall surfaces defining a downwardly sloping retort chamber that may be constructed as a readily portable unit. Within the retort chamber the raw oil shale is preheated and then moved countercurrent to gravity flow and crushed by means of a movable blade that also serves to hold the oil shale for a holding time sufficient to enhance a substantially complete recovery. The crushed raw oil shale travels by gravity flow through an annular flow passage inclined downwardly at an adjustable angle to the horizontal whereby the oil shale is heated to produce hydrocarbon vapors. Spent shale is passed through a normally-closed, valve-controlled outlet. A cooled condenser pipe receives vapors from the retort chamber and the condenser pipe has valve-controlled outlets at different elevations to select oil in liquid form having a range of different weights from the lighter ends to the heavier ends, or the products are removed from the condenser pipe to a refinery unit for further refining as required.

Other objects, advantages and capabilities of the present invention will become more apparent as the description proceeds, taken in conjunction with the accompanying drawings in which like parts have similar reference numerals and in which.

Figure 1:
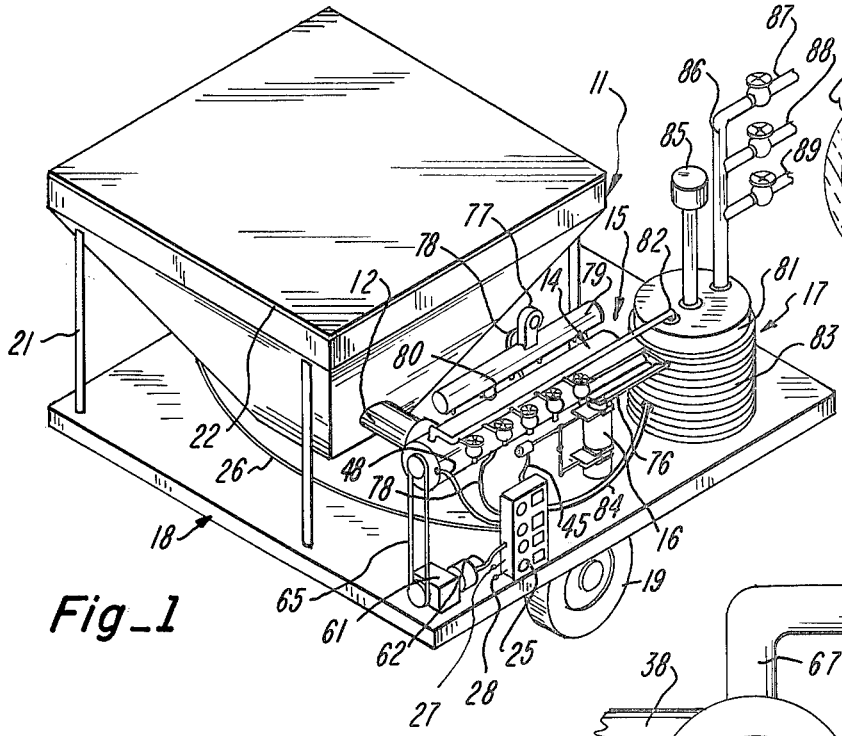
FIG. 1 is a perspective view of portable apparatus for recovering oil products from oil shale embodying features of the present invention.
Figure 5:
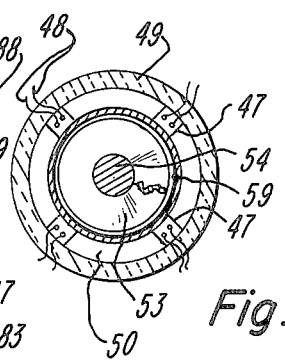
FIG. 5 is a sectional view taken along lines 5—5 of FIG. 4.
Figure 3:
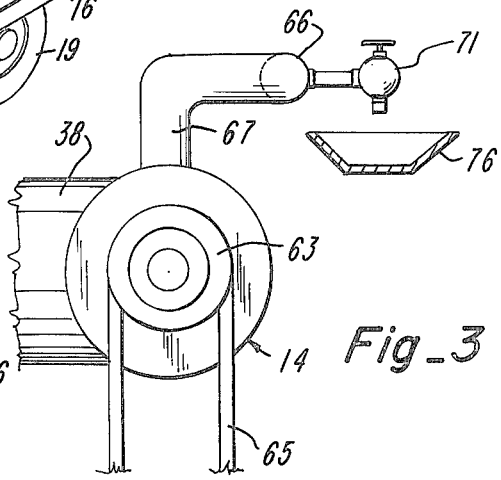
FIG. 3 is an enlarged end elevational view of a portion of the apparatus shown in FIG. 1.
Figure 2:
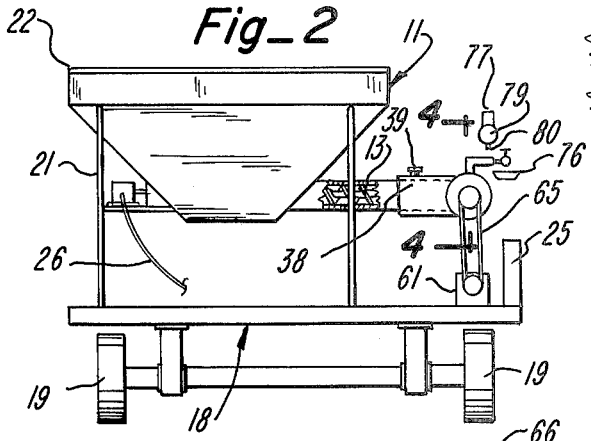
FIG. 2 is an end elevational view of the apparatus shown in FIG. 1.
Figure 4:
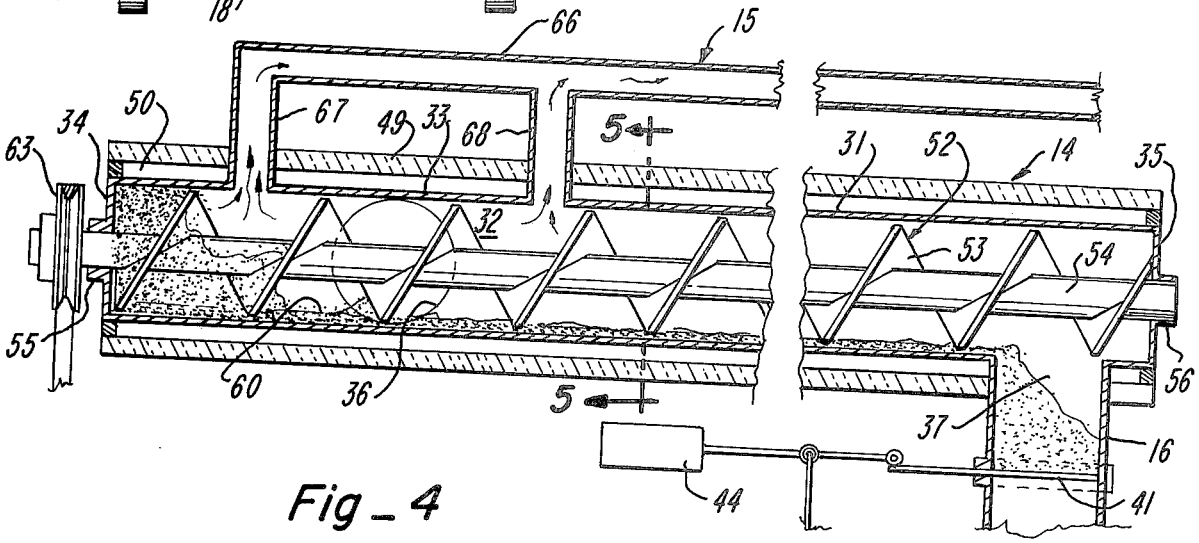
FIG. 4 is a longitudinal sectional view taken along lines 4—4 of FIG. 2.

Referring now to the drawings, the apparatus shown includes a feed hopper 11 having a feed conduit 12 with an auger 13 supplying selected, controlled amounts of crushed oil shale contained in hopper 11 to a retort 14. Oil product vapors are removed from the retort 14 to a condenser 15 and spent shale is selectively discharged through an outlet conduit 16. Oil products are removed directly from the condenser 15 or the heated oil products may be further refined or purified in a refinery 17 adjacent the retort 15. The above described apparatus is shown as supported on a common portable platform 18 mounted on wheels 19 for vehicular movement thereof to a location of use.

The feed hopper 11 shown is in the form of a generally conically shaped hollow body supported by upright braces 21 with a top material-receiving opening that is shown covered by a lid 22 and sealed along contacting surfaces to be fully closed so as to prevent oil product vapors from escaping through the top of the hopper. The feed hopper 11 contains a supply of crushed oil shale, preferably on the order of approximately ¼ inch mesh size. The feed conduit 12 extends laterally out from an upright side wall portion of the hopper at the bottom and is arranged in flow communication with the hopper and the retort 14 to feed raw oil shale to the retort 14. The auger 13 is driven by a suitable electrically powered drive 24 that is readily turned on and off at a control panel 25 with an electric power line 26 shown connected between the drive 24 and control panel 25. The control panel 25 has input terminals represented at 27 and 28 to which electric power is connected from a suitable power line transformer or the like.

The auger 13 is of a conventional construction similar to that found in a coal stoker that operates so that the crushed oil shale is moved axially along the feed conduit 12 during only a selected portion of each full revolution of the shaft so that the raw oil shale stored in the hopper is positively fed or moved axially at a relatively slow rate through the feed conduit to provide a means for controllably supplying selected amounts of raw oil shale to the retort 14. The shaft rotates at a slow speed of on the order of 0.5 rpm and the amount of axial travel of the blade per revolution is adjustable in a manner known in the art to regulate the amount of shale fed into the retort 14.

The retort 14 shown has a housing 31 of generally cylindrical shape that is supported at its upper end from the feed conduit 12 and hopper 11. Housing 31 extends at a selected downwardly sloping angle, herein shown as on the order of 15° from the horizontal. The housing 31 is made of a rigid, heat-conductive material such as stainless steel, ceramic, etc., with inner surfaces defining a downwardly sloping retort chamber 32. More specifically, the retort housing 31 includes a cylindrical longitudinal wall portion 33, an upper end wall portion 34, and a lower end wall portion 35. An aperture 36 in the longitudinal wall portion adjacent the upper end wall portion is in flow communication with the feed conduit to provide a feed inlet into the retort chamber 32 and an aperture 37 in the longitudinal wall portion adjacent the lower end wall portion provides an outlet from the retort chamber for the passage of spent oil shale from the retort chamber.

A feed conduit 38 is mounted at the upstream end of the housing 31 and extends at right angles thereto and releasably telescopes over and is fastened to the preheating tube 13 as with a set bolt 39. In this way housing 31 may be rotated up and down in a vertical plane about a horizontal axis at the center of feed conduit 38 and the setting of the bolt 39 establishes the angle of incline for the housing 21. The angle of incline establishes the heating time for the oil shale passing through the retort chamber.

The outlet conduit 16, having one end surrounding opening 37, is provided with an upper valve 41 and a lower valve 42 which are operated alternately between open and closed positions through linkage 43 by a solenoid represented at 44. The solenoid 44 is shown as connected by an electric power line 45 to the control panel 25. The upper valve 41 is normally closed to close off the retort chamber at the outlet portion to keep the outlet closed to the atmosphere at all times to prevent combustion due to the high temperatures involved in heating the oil shale in the retort chamber. When valve 41 is moved to the open position to discharge the spent oil shale, lower valve 42 is moved to a closed position by the linkage 43 between the solenoid and the valves.

Electric resistance strip heaters 47 are mounted on the external periphery of housing 31 and extend lengthwise thereof at circumferentially spaced intervals as a means of heating the walls of the housing 31 in the embodiment of FIGS. 1–6. The heated walls of housing 31 in turn heat the oil shale contained within the retort chamber as the oil shale passes along the inside thereof in direct contact with the heated wall surfaces. Electric power lines connect to each heater 47 and are connected to the control panel 25 by an electric power line 48. A layer of heat insulation 49 surrounds the housing 31 and the heaters 47 in spaced relation thereto to form an outer chamber 50. The layer of heat insulation 49 and chamber 50, which serves as insulation, reduce heat losses.

A rotating member 52 is mounted in an inner spaced concentric relation within the housing 31 about an axis of rotation inclined from the horizontal at a sufficient angle for gravity to cause movement of the crushed oil shale between the inlet 36 and the outlet 37. This rotating member 52 shown has a continuous, imperforate blade portion 53 spaced helically along and on a rotary shaft 54 for rotation about the inclined axis of rotation. The shaft is journaled in bearings 55 and 56 in the end wall portions 34 and 35, respectively. These bearings are of the type capable of withstanding high temperatures on the order of above 900° F. The peripheral rims of the blade portions are arranged in spaced relation to the inner wall surfaces of the housing 31 to define the annular flow passage 59 through which travels a thin body or layer of crushed raw oil shale, indicated by numeral 60.

The motive power for rotating the member 52 is comprised of a constant speed electric motor drive 61 provided electric power through the control box 25 by an electric power line 62. In the drive train between the drive 61 and shaft 54 there is a pulley 63 on shaft 54, a pulley 64 on the drive 61, and a belt 65.

The condenser 15 includes a downwardly sloping condensing tube 66 mounted above the retort housing and supported thereon by means of two right-angle pipes 67 and 68 through which oil product vapors pass in passing from the upper portion of the retort chamber into the condensing tube 66. The condensing tube 46 has a plurality of outlet pipes each with on-off control valves 71, 72, 73, 74 and 75. These valve-controlled pipes are positioned at spaced intervals along tube 46 which is on an incline to the horizontal so that they are positioned at different elevations. Condensed oil products in condensing tube 46 may be selectively removed according to weight by opening a selected valve. A tray 76 is shown as below the valves to receive the oil products discharged therefrom. The condenser 15 also includes a cooling device for tube 66 shown as a blower 77 supplied electric power from an electric power line 78 via the control panel 25 with the blower feeding a discharge manifold 79 having a plurality of spaced outlets 80 along the condensing tube 66 distributing cooler air over the condensing tube 66 to cool the condensing tube to condense the oil product vapors to a liquid form.

The refinery 16 shown comprises an upright tower 81 supported on the base 18 which also supports retort 14, and the heated oil products pass into the tower via a vertical inlet pipe section 82. The oil products are heated to vaporizing temperatures by a heating coil 83 surrounding the bottom of the tower, which in turn receives power via a power line 84 connected to control panel 25. In addition, the refining may be enhanced by the addition of a suitable catalyst contained in a supply tank 85 located above the tower 81 and feeding down through the top thereof. A vertical conduit 86 extends out the top of the tower and has several valve-controlled pipes 87, 88 and 89 located at different elevations through which oil product vapors pass according to weight.

In the operation of the above described apparatus, the crushed raw oil shale in the hopper 11 is controllably moved in selected amounts from the hopper 11 into the inlet 36 of the retort chamber by the rotation of auger 13. The housing 31 heated by strip heaters 47 transmits heat to tube 12 which preheats the incoming oil shale. In the retort chamber 52 the preheated, raw oil shale is first moved by the blade portion 53 against the upstream end wall 34 to crush the raw oil shale while at the same time it is further heated from the heat within the chamber. The crushed oil shale moved along a downwardly inclined slope by gravity flow through the annular flow passage 59 between the outer peripheral edges of the blade 53 and the inner wall surfaces of the housing and heat is applied through these wall surfaces to the oil shale while confined to the flow passage 59. This application of heat converts the raw oil shale to oil product vapors which collect in the upper portion of the retort chamber.

The layer or body of oil shale 60 moves continuously and finally passes through the outlet 37 after substantially all of the oil products have been removed, and is spent oil shale. In rotating member 52 in a direction to cause movement countercurrent to gravity flow, the oil shale is effectively retained or held in the retort chamber for a time sufficient to substantially complete a full recovery of all oil products and the discharge is in the form of a dry powder, which of course may contain other valuable minerals. The valve 41 at the outlet is normally closed but is opened periodically to discharge the spent shale via conduit 16.

The angle of incline for housing 31 preferably is between 10° and 20° to the horizontal and typically is about 15° to the horizontal. The temperature of the retort chamber is at least 900° F and frequently above 900° F.

By way of example and not limitation, a retort chamber shown in FIGS. 1–6 typically has an internal diameter of about 5 inches and is 5 feet in length. The gap or spacing between the periphery of the blade and the heated wall surfaces is on the order of 1/16 inch.

Figure 8:
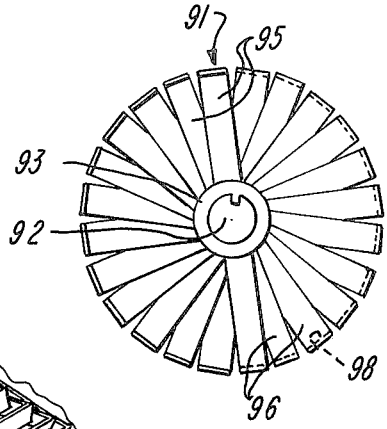
FIG. 8 is an end elevational view of the movable blade shown in FIG. 7.
Figure 7:
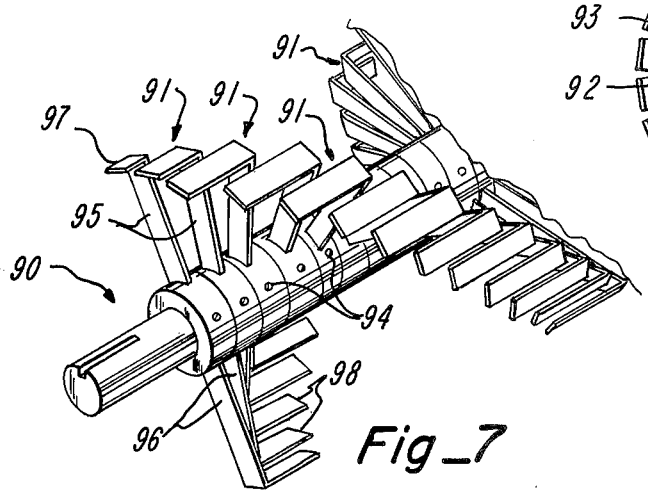
FIG. 7 is a perspective view showing a fragment of an alternative form of rotating member for use in the retort chamber.

An alternative form of rotating member 90 shown in FIGS. 7 and 8, which is used for larger scale operations, has a blade portion made up of individual blade segments 91 spaced helically along and mounted on a rotary shaft 92 for rotation about an inclined axis of rotation. Each blade segment shown is identical and comprises a hub 93 movable relative to shaft 92 and affixed at a selected position by one or more set screws 94. Each blade segment has a pair of diametrically opposite, radially extending arm portions 95 and 96 affixed to the hub 93, an axially extending front arm portion 97 affixed to the end of the radial arm 95, and an axially extending rear arm 98 affixed to the opposite end so that, as seen in side elevation, the blade segments are generally Z-shaped. Each successive blade is spaced helically along the shaft and axis of rotation with each rotated through an angle to leave a slight gap between blade segments at the periphery.

A structure using the blade segments as shown in FIGS. 7 and 8 typically has a retort chamber with a diameter of 24 inches and is 20 feet in length. The blade segments are 6 inches wide with the front and rear arms 2 inches in length. The blade segments are spaced about 2 inches apart along the shaft.

Figure 9:
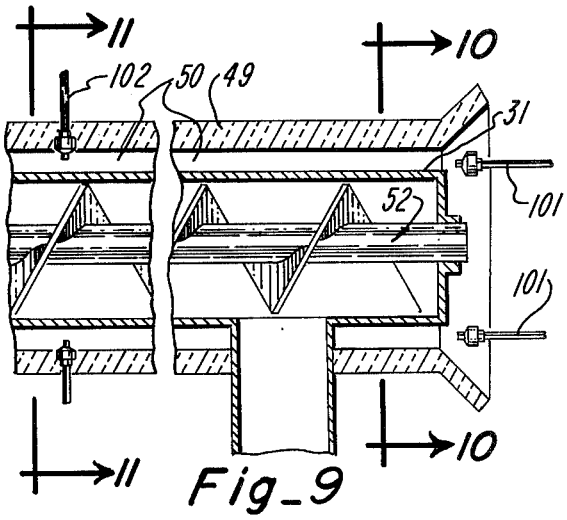
FIG. 9 is a longitudinal sectional view of another form of retort housing that is heated by a gas burner.
Figure 10:
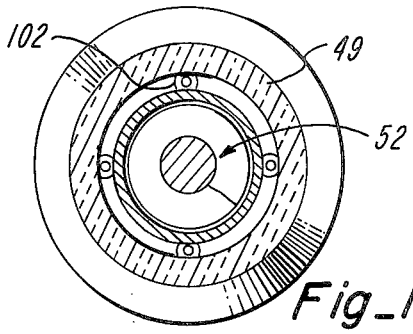
FIG. 10 is a sectional view taken along lines 10—10 of FIG. 9.
Figure 11:
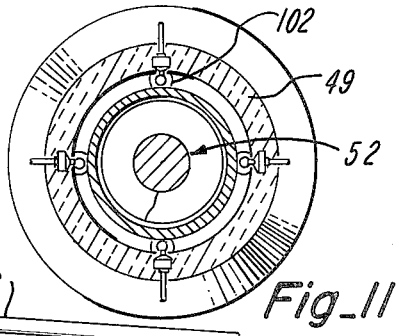
FIG. 11 is a sectional view taken along lines 11—11 of FIG. 9.
Figure 6:
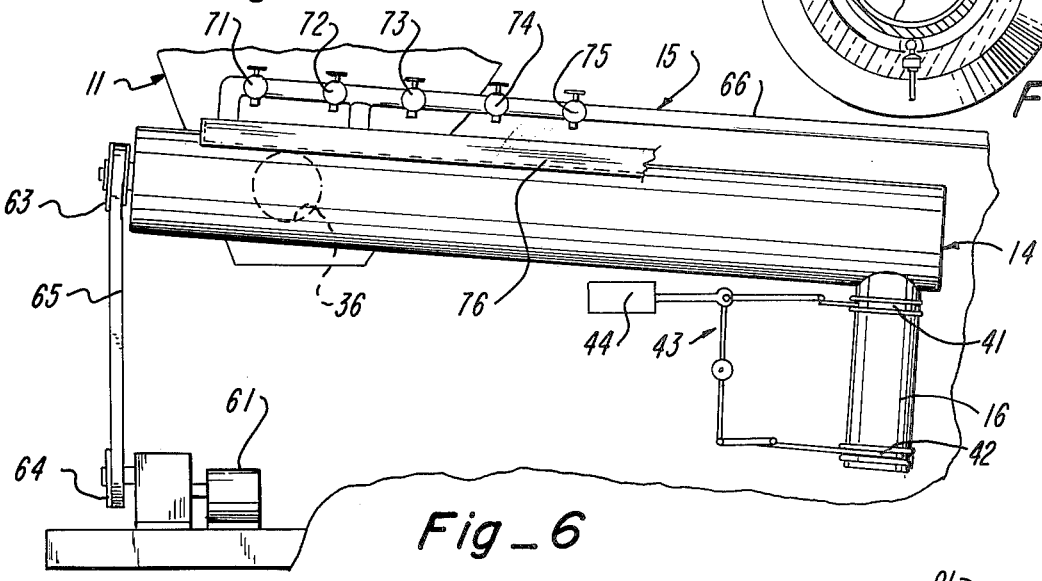
FIG. 6 is an enlarged side elevational view of a portion of the apparatus shown in FIG. 1.

Referring now to FIGS. 9, 10 and 11, there is shown an alternative heating means for the retort housing wherein the lower end of the space 50 between the heat insulation 49 and tubular housing 31 is left open and a plurality of axially extending burner heads 101 are arranged at circumferentially spaced intervals in the lower open ends. These burner heads are supplied a liquid fuel such as propane and produce a flame which heats the tubular housing. Additionally, a plurality of radially extending burner heads 102 are provided in the area of the inlet opening at circumferentially spaced intervals to adequately heat the housing 31 which in turn heats the oil shale within the retort chamber.

Although the present invention has been described with a certain degree of particularity, it is understood that the present disclosure has been made by way of example and that changes in details of structure may be made without departing from the spirit thereof.

What is claimed is:

1. In apparatus for recovering oil products from oil shale and the like, the combination comprising:

means including a generally cylindrically shaped retort with a heat-conductive wall having a heated inner surface defining a retort chamber, said chamber having an inlet and an outlet and sloped downwardly for gravity flow from said inlet to said outlet and having a rotating member in said retort having a conveyor portion extending out from a rotary shaft arranged to force oil shale passed into said inlet in a direction countercurrent to gravity flow and having a peripheral surface area defining an annular flow passage between said heated inner surface and said peripheral surface area for crushing oil shale and confining the crushed oil shale to a layer to which heat is applied from said heated inner surface as the layer is moved from the inlet through an outlet to produce oil product vapors;

means for removing and condensing the oil product vapors into oil product liquids; and means for selectively removing spent oil shale through said outlet.

2. In apparatus as set forth in claim 1 wherein the angle of slope is adjustable to change the heating time for the oil shale.

3. In apparatus as set forth in claim 1 wherein said means defining a retort chamber includes an elongated housing made of heat-conductive walls, an air space surrounding said housing, and a layer of heat insulation enclosing said air space.

4. In apparatus as set forth in claim 3 including electric heating means on said housing covered by said heat insulation.

5. In apparatus as set forth in claim 4 including gas-fired burner means located in the space between said heat insulation and said housing for heating said housing.

6. In apparatus as set forth in claim 5 including burner means extending axially into the space between said heat insulation and said housing at the downstream end and extending radially into said space between said inlet and said outlet.

7. In apparatus as set forth in claim 1 wherein said rotating member includes a rotating blade with blade portions spaced helically along a central shaft portion journaled for rotation in bearings at the ends of said housing.

8. In apparatus as set forth in claim 7 wherein said blade portions are rotated to move the oil shale in a direction countercurrent to gravity flow.

9. In apparatus as set forth in claim 3 wherein said means for removing and condensing includes at least one upright pipe projecting up from the housing and supporting a condensing tube above said housing, said condensing the extending substantially parallel to said housing on a downwardly sloping incline.

10. In apparatus as set forth in claim 9 wherein said condensing tube has a plurality of valve-controlled pipe sections mounted thereon at spaced intervals to selectively remove the condensed oil products according to weight.

11. In apparatus as set forth in claim 9 wherein said condensing tube is coupled to the inlet pipe of a refining unit that further refines the oil product liquids.

12. In apparatus as set forth in claim 1 wherein said means for selectively removing spent shale includes a valve-controlled outlet having a first valve that is in a normally closed position, a second valve in a normally open position, and valve actuation means to alternately open said first valve and close said second valve to dispense said spent oil shale from said retort chamber while the retort chamber remains closed to the atmosphere.

13. In apparatus for recovering oil products from raw oil shale and the like, the combination comprising:

an elongated, generally cylindrically shaped housing having heat-conductive walls with inner surfaces defining a retort chamber, said housing having a longitudinal wall portion, an upper end wall portion, a lower end wall portion, and an outlet spaced a distance from the inlet along said chamber, said retort housing and chamber being sloped downwardly for gravity flow of the oil shale therethrough from said inlet to said outlet;

a rotating member in said retort housing having conveyor blade portions extending out from a central rotary shaft portion arranged to force the incoming raw oil shale countercurrent to the gravity flow, said conveyor blade portions having a peripheral surface area defining an annular flow passage between said inner surfaces and said peripheral surface area for crushing oil shale and confining the crushed oil shale to a layer to which heat is applied from said inner surfaces;

means for heating the oil shale moving in said annular flow passage as the oil shale travels through said flow passage from said feed portion to said discharge portion by heating said inner surfaces to produce oil product vapors in said retort chamber and resulting in spent oil shale that is delivered via said annular flow passage by gravity flow to said discharge portion;

a condenser coupled to said retort chamber arranged for removing the oil product vapors therefrom at different points of elevation along said housing and condensing said vapors into a liquid form; and valve means normally closing said outlet portion that is selectively opened, while keeping the inside of said retort chamber closed to the atmosphere, to discharge the spent oil shale.

14. In apparatus as set forth in claim 13 including a feed hopper containing a supply of crushed oil shale having a lid closing the top to prevent the loss of vapors therethrough, a feed tube extending laterally out an upright sidewall portion of the hopper at the bottom in flow communication with the inlet of said retort chamber, and a movable member in said feed conduit arranged for controllably supplying selected amounts of crushed raw oil shale from said hopper into said retort chamber.

15. In apparatus as set forth in claim 13 further including a refining unit coupled to said condenser and supported on a common portable platform with said elongated housing, said refining unit including a heated tower, means for supplying a catalyst to the interior of said tower, and means for removing oil products according to weight.

16. In apparatus as set forth in claim 13 wherein said rotating member has a continuous imperforate blade portion spaced helically along a rotary shaft portion.

17. In apparatus as set forth in claim 13 wherein said rotating member is comprised of a plurality of blade segments spaced helically along a common rotary shaft, each said blade segment having a hub releasably secured to said shaft, a pair of diametrically opposite, radially extending arms, an axially extending front arm at the end of one of said radially extending arms, and an axially extending rear arm at the end of the other of said radially extending arms.

18. In apparatus as set forth in claim 17 wherein said blade segments are rotated relative to one another on the supporting shaft to provide a gap at the periphery between successive blade segments.

19. In apparatus as set forth in claim 14 wherein said elongated housing has a feed conduit at the upstream end that extends at right angles to said housing and releasably telescopes over and is releasably fastened to said feed tube with a bolt means whereby said housing is supported for rotation up and down in a vertical plane about a horizontal axis to adjust the angle of inclination of said housing.

20. In a method of recovering oil from oil shale and like materials, the steps of:

controllably supplying selected amounts of raw oil shale to an upper feed inlet of a generally cylindrical retort chamber having heat-conductive walls with inner surfaces and a lower outlet and generally inclined so that the shale will gravitate from said inlet toward said outlet;

crushing the raw oil shale between moving peripheral surface areas on a rotating member in the chamber and said inner surfaces of said walls defining said chamber while conveyor portions on said rotary member are moved in a direction to cause shale to move countercurrent to gravity flow in the retort chamber, and confining the crushed oil shale to a layer that travels from the upper feed inlet to and through said lower outlet by gravity flow while heat is applied thereto through said walls in the retort chamber to retain oil product vapors therein; and removing the oil product vapors from an upper portion of said retort chamber.

21. In a method as set forth in claim 20 wherein said removed hydrocarbon vapor products are condensed externally of said retort chamber to a liquid form.

22. In a method as set forth in claim 21 wherein hydrocarbon vapor products are removed at different points of elevation to provide products of different weights.

23. In a method as set forth in claim 21 wherein said raw oil shale is heated prior to passing through the inlet of said retort chamber.

24. In a method as set forth in claim 20 wherein said retort chamber is at a temperature of at least 900° F.

25. In a method as set forth in claim 20 wherein the angle of travel of the oil shale in the retort chamber is changed to control the heating time of the oil shale in the retort chamber.

26. In a method as set forth in claim 20 wherein the movement of the layer of oil shale in the retort chamber is between about 10° and 20° to the horizontal.

27. In a method as set forth in claim 21 wherein the condensed oil products are removed to a refinery unit for further refining of the oil products and separation according to weight.

* * * * *